US007290576B2

(12) United States Patent
Suzuki

(10) Patent No.: US 7,290,576 B2
(45) **Date of Patent: *Nov. 6, 2007**

(54) COMPRESSED WOOD PRODUCT AND METHOD OF MANUFACTURING COMPRESSED WOOD PRODUCT

(75) Inventor: Tatsuya Suzuki, Tokyo (JP)

(73) Assignee: Olympus Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/356,484

(22) Filed: Feb. 17, 2006

(65) Prior Publication Data

US 2006/0151067 A1 Jul. 13, 2006

Related U.S. Application Data

(63) Continuation of application No. PCT/JP2005/016067, filed on Aug. 26, 2005.

(30) Foreign Application Priority Data

Nov. 8, 2004 (JP) ..... 2004-323935

(51) Int. Cl.
*B27D 1/00* (2006.01)
*B27F 7/00* (2006.01)

(52) U.S. Cl. ..... 144/344; 144/346; 144/352; 144/180; 428/106

(58) Field of Classification Search ..... 144/344–346, 144/350, 352, 354, 349, 361, 362; 428/105, 428/106, 114, 292.4; 264/112, 113, 119; 100/35

See application file for complete search history.

(56) References Cited

U.S. PATENT DOCUMENTS

| | | | | |
|---|---|---|---|---|
| 2,649,124 | A * | 8/1953 | Merron | 144/348 |
| 4,484,688 | A * | 11/1984 | Smith | 217/91 |
| 5,415,943 | A * | 5/1995 | Groger et al. | 428/537.1 |
| 5,682,936 | A * | 11/1997 | Higdon, Jr. | 144/345 |
| 5,746,863 | A * | 5/1998 | Jarrett | 156/218 |
| 5,881,786 | A * | 3/1999 | Wilderman et al. | 144/348 |
| 6,418,990 | B1 * | 7/2002 | Lindstrom | 144/348 |
| 6,837,953 | B2 * | 1/2005 | Kai | 156/182 |
| 2002/0148532 | A1 * | 10/2002 | Kitazawa et al. | 144/361 |

FOREIGN PATENT DOCUMENTS

| | | |
|---|---|---|
| JP | 08-025301 | 1/1996 |
| JP | 11-077619 | 3/1999 |
| JP | 2002119657 A * | 4/2002 |

* cited by examiner

*Primary Examiner*—Bena Miller
(74) *Attorney, Agent, or Firm*—Hogan & Hartson LLP

(57) ABSTRACT

A compressed wood product includes a first part composed of a wooden material compressed into a predetermined shape; and a second part to be joined with the first part. A direction of wooden fibers of the wooden material composing the first part is substantially parallel with a lengthwise direction of the first part and intersects with a thickness direction of the first part. At least one surface of the second part is substantially perpendicular to the lengthwise direction of the first part.

7 Claims, 7 Drawing Sheets

COMPRESSED WOOD PRODUCT AND METHOD OF MANUFACTURING COMPRESSED WOOD PRODUCT

CROSS-REFERENCE TO RELATED APPLICATIONS

This application is a continuation of PCT international application Ser. No. PCT/JP2005/016067 filed Aug. 26, 2005 which designates the United States, incorporated herein by reference, and which claims the benefit of priority from Japanese Patent Application No. 2004-323935, filed Nov. 8, 2004, incorporated herein by reference.

BACKGROUND OF THE INVENTION

1. Field of the Invention

The present invention relates to a compressed wood product made of a compressed wooden material and a method of manufacturing the compressed wood product.

2. Description of the Related Art

In recent years, techniques for processing wooden materials by compressing and shaping the same into a desired shape have been focused. Since wooden materials, being natural materials, produce a wide variety of grain patterns, wood products exhibit different grain patterns depending on positions of raw wood from which the particular wood products are cut out. Such different grain patterns as well as surface damages and discoloration caused by a long-term use create unique textures which tend to evoke warm feeling in the user. Thus, the wooden material attracts attention as a material for products of uniqueness and taste which cannot be found in products made of synthetic resin or light metals.

According to one conventionally known technique for compression process of wooden materials: a wooden board is softened with water absorption and compressed; the compressed wooden board is cut along a direction substantially parallel with a direction in which the compressing force is applied, whereby a primary fixed product with a sheet-like shape is obtained; and the primary fixed product is shaped into a desired three-dimensional shape under heat and moisture (for example, see Japanese Patent No. 3078452 Publication). Further, according to another conventional technique, a wooden board compressed in a softened state is temporarily secured in a prepared mold and left in the mold until the wooden board, recovers. Thus a wood product with a desired shape can be obtained (see, for example, Japanese Patent Application Laid-Open No. H11-77619 Publication).

SUMMARY OF THE INVENTION

A compressed wood product according to one aspect of the present invention includes: a first part composed of a wooden material compressed into a predetermined shape; and a second part to be joined with the first part; wherein a direction of wooden fibers of the wooden material composing the first part is substantially parallel with a lengthwise direction of the first part and intersects with a thickness direction of the first part, and at least one surface of the second part is substantially perpendicular to the lengthwise direction of the first part.

A method, according to another aspect of the present invention, of manufacturing a compressed wood product including a first part composed of a compressed wooden material and a second part joined with the first part, includes: forming the first part by cutting out a wooden material to be the first part so that a direction of wooden fibers in the wooden material is substantially parallel with a lengthwise direction of the wooden material and intersects with a thickness direction of the wooden material, and further compressing the cut-out wooden material to a predetermined shape; and joining the first part and the second part so that at least one surface of the second part is substantially perpendicular to the lengthwise direction of the first part.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
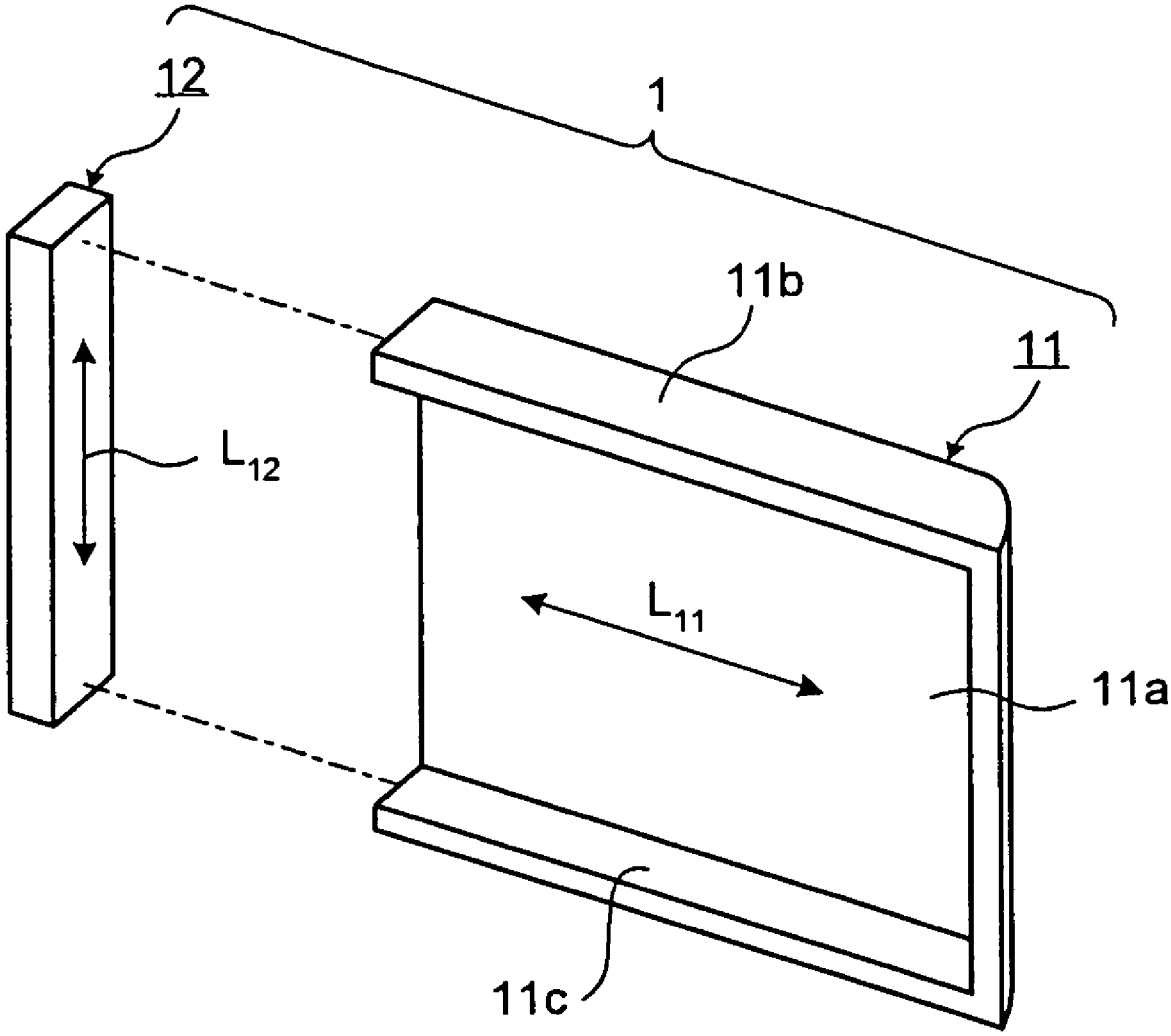
FIG. 1 is an exploded perspective view of a structure of a compressed wood product according to an embodiment of the present invention.

Hereinafter, an embodiment of the present invention will be described with reference to the accompanying drawings. FIG. 1 is an exploded perspective view of a structure of a compressed wood product according to the embodiment of the present invention. A compressed wood product 1 shown in FIG. 1 includes a main part 11 (first part) having a substantially round side surface at one end, and a plate-like sub-part 12 (second part). The main part 11 and the sub-part 12 are joined together to form the compressed wood product 1.

The main part 11 includes a main plate 11*a* having a curved surface in a vicinity of one end and a plane surface in a vicinity of another end, and two side plates 11*b* and 11*c* of substantially the same shape that extend along a lengthwise direction of the main plate 11*a* and substantially perpendicular to the main plate 11*a*. An edge surface of the main part 11 that contacts with the sub-part 12 has a depression. The main part 11 is made of compressed wood, of which wooden fibers extend in a direction $L_{11}$ substantially parallel with the lengthwise direction of the main part 11. The direction of wooden fibers $L_{11}$ intersects with a thickness direction of the main part 11 at any position.

The sub-part 12 is of a rectangular solid shape and made of compressed wood similarly to the main part 11. A direction $L_{12}$ of wooden fibers of the sub-part 12 extends substantially parallel with the lengthwise direction of the sub-part 12 and substantially perpendicular to the thickness direction of the sub-part 12. Hence, both in the main part 11 and in the sub-part 12, the wooden fibers extend continuously without fragmentation as to prevent drastic decrease of strength at any point. Thus, the compressed wood product 1, which consists of the main part 11 and the sub-part 12 joined together, has a high and uniform strength against bending, pulling, or the like at any point.

Next, a method of manufacturing the compressed wood product 1 with the above-described structure is described. First, the wood which is a raw material for the main part 11 and the sub-part 12 is cut out from uncompressed raw wood so that the cut out portions are larger in volume than finished products by an amount to be decreased in the compression process described later.

Figure 2:
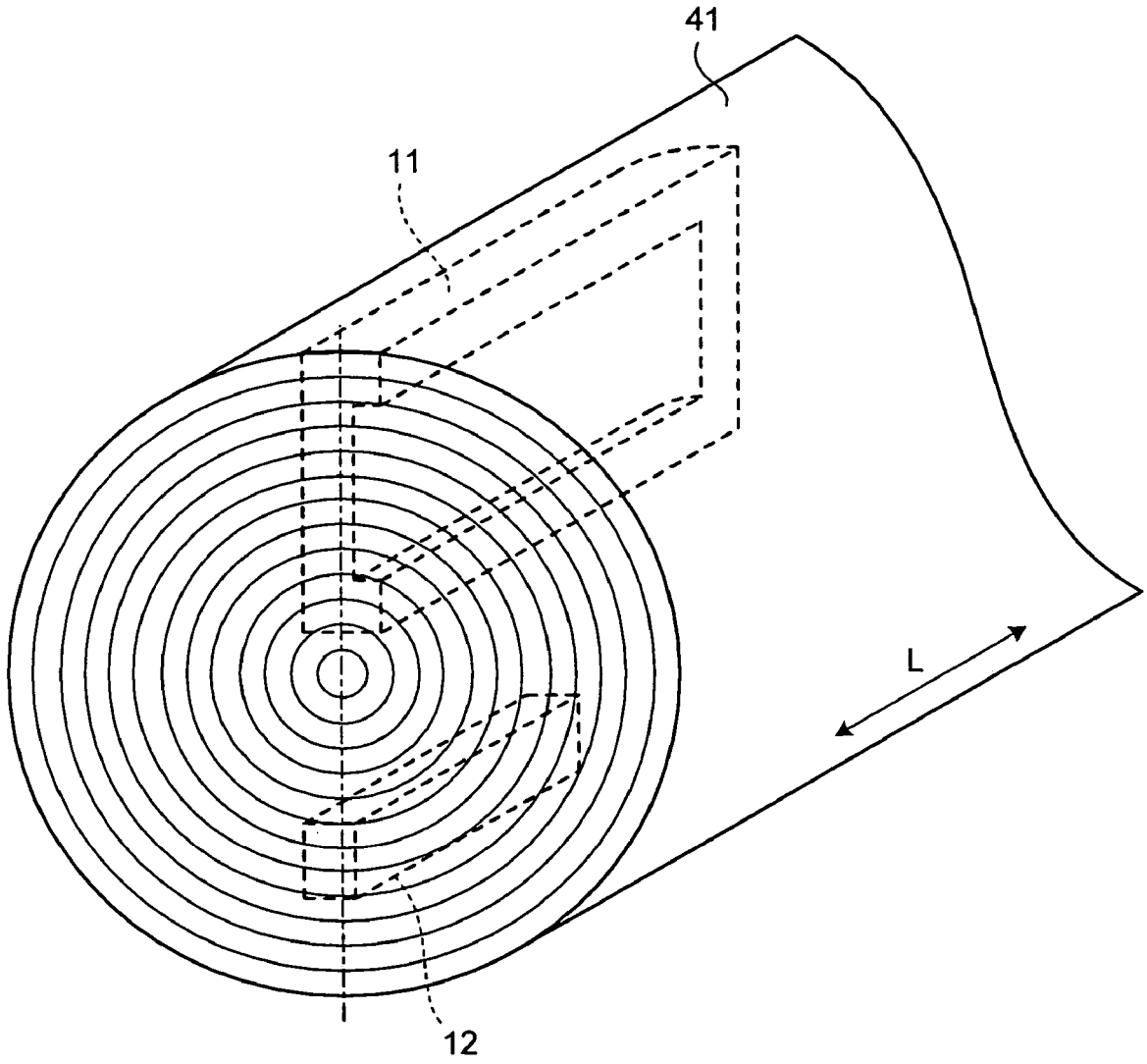
FIG. 2 is an explanatory diagram which schematically shows shaping of a wooden material from uncompressed raw wood.

FIG. 2 is an explanatory diagram which schematically shows shaping of the main part 11 and the sub-part 12 from the uncompressed raw wood. As shown in FIG. 2, the main part 11 is shaped so that a lengthwise direction of the main plate 11*a* is substantially parallel with a direction L of wooden fibers of a raw wood 41. Since a curved surface of the main plate 11*a* of the main part 11 at this stage forms a relatively gentle slope compared with a finished surface, the thickness direction of the main part 11 is generally perpendicular to the direction L of wooden fibers. In particular, the main part 11 is shaped so that the thickness direction is substantially perpendicular to the direction L of wooden fibers at positions other than the curved surface of the main plate 11*a*.

The sub-part 12 is also shaped so that the lengthwise direction of the sub-part 12 is substantially parallel with the direction L of wooden fibers of the raw wood 41. Since the sub-part 12 is of a rectangular solid shape, thickness direction thereof is substantially perpendicular to the direction L of wooden fibers.

In FIG. 2, both in the main part 11 and in the sub-part 12, a surface with a largest area has a straight grain. The main part 11 and the sub-part 12, however, may be shaped in a different manner. For example, the main part 11 and the sub-part 12 may be cut out from any position of the raw wood 41 as far as the lengthwise direction of the main plate 11*a* and the lengthwise direction of the sub-part 12 are arranged substantially parallel with the direction L of wooden fibers of the raw wood 41. Then, a largest surface of the main part 11 or the sub-part 12 may have a flat grain or an intermediate grain pattern of flat grain and straight grain. Thus, the main part 11 and the sub-part 12 may be cut out from the raw wood 41 in a most suitable manner in consideration of required strength, appearance, or the like, for the compressed wood product 1.

As can be seen from the foregoing, the method of manufacturing the compressed wood product according to the embodiment is not dependent on the grain pattern on the surface of the shaped wooden part. Hence in the drawings, the main part 11 and the sub-part 12 are illustrated without indication of grain patterns thereof.

The raw wood 41 which is employable in the embodiment is, for example, Japanese cypress, hiba cedar, paulownia, Japanese cedar, pine, cherry, zelkova, ebony wood, teak, mahogany, and rosewood. Any of these types of wood can be employed as the raw wood 41 for the embodiment of the present invention and a suitable wood type is selected according to the use of the compressed wood product.

Figure 3:
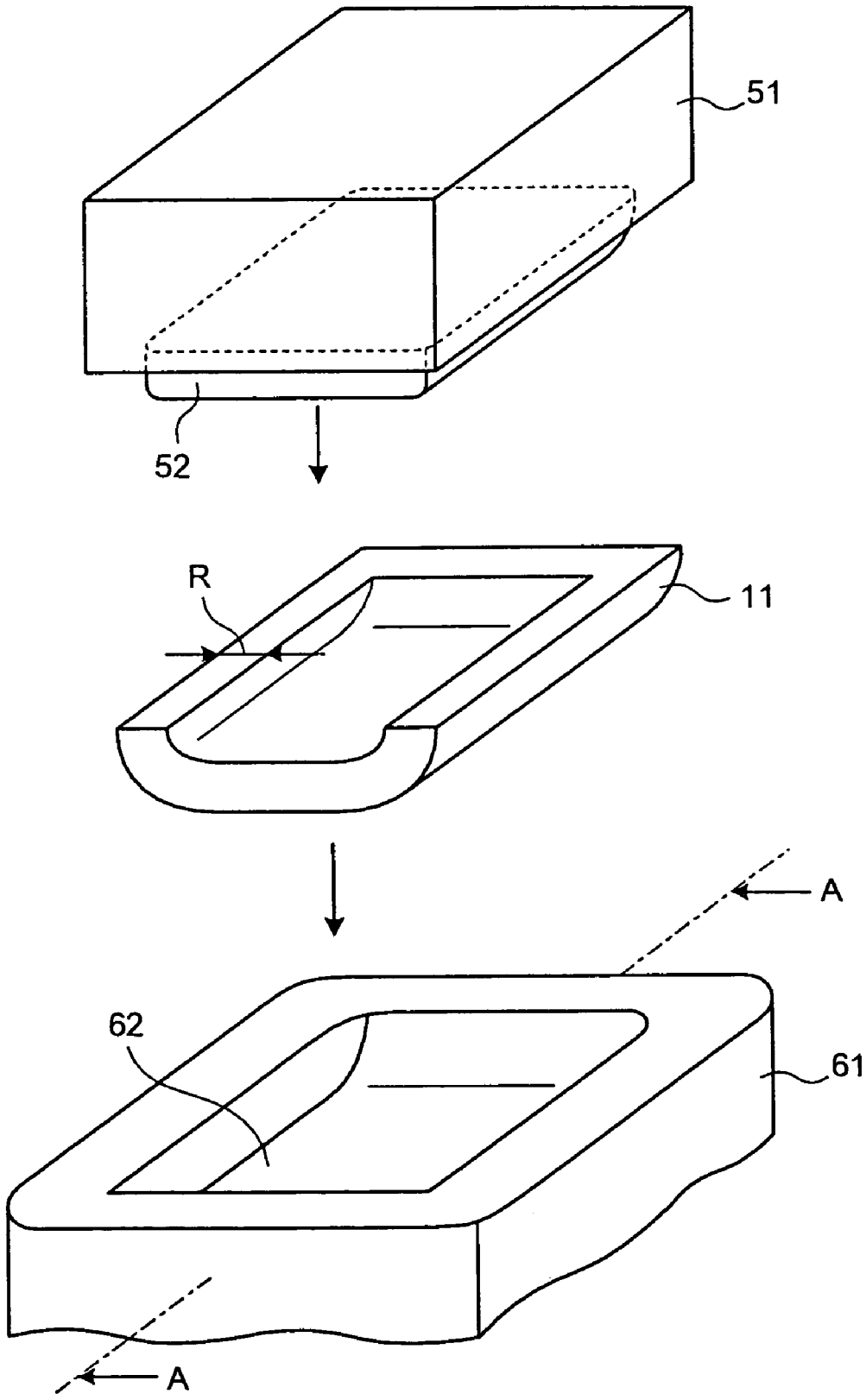
FIG. 3 is an explanatory view showing an outline of a compression process in a method of manufacturing the compressed wood product according to the embodiment of the present invention.
Figure 4:
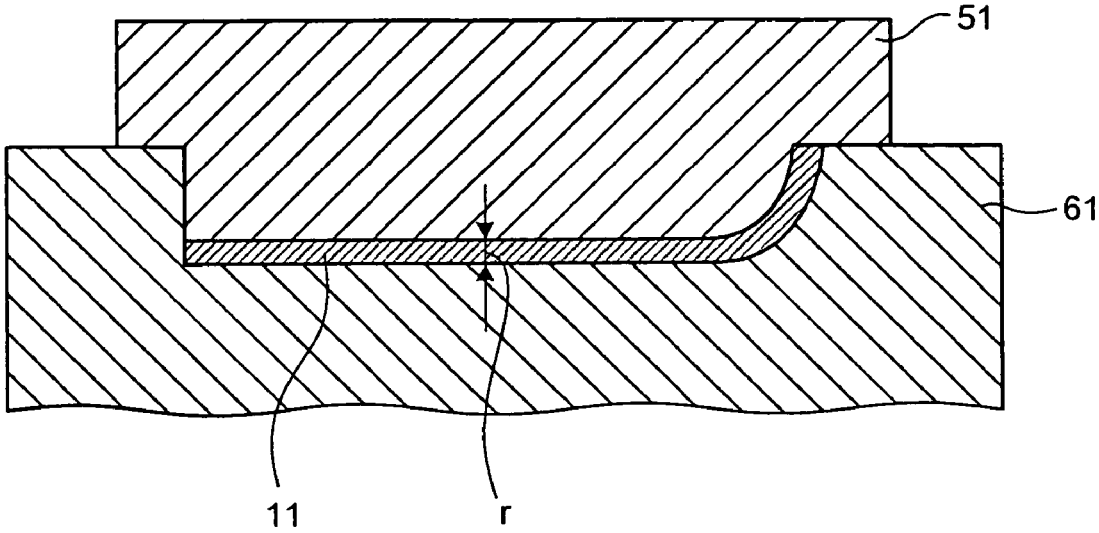
FIG. 4 is a vertical sectional view of the compressed wood product under compression in the compression process.

A compression process will be described in which the main part 11 is compressed into a desired shape. FIG. 3 is an explanatory view showing an outline of the compression process. FIG. 4 shows a state of the main part 11 under compression, i.e., a state where deformation of the main part 11 has nearly finished. FIG. 4 is a vertical section of the main part 11 shown in FIG. 3. As shown in FIGS. 3 and 4, a metal mold 51 used to apply compressing force to the main part 11 from above the main part 11 during the compression process has a downward protrusion 52 which corresponds with a shape of an internal surface of the main part 11. On the other hand, a metal mold 61 used to apply compressing force to the main part 11 from below the main part 11 during the compression process has a downward depression 62 which corresponds with a shape of an external surface of the main part 11.

Before the compression process, the main part 11 is left in a water vapor atmosphere in high temperature and high pressure for a predetermined time period. Thus, the main part 11 absorbs water in excess to be softened. Thereafter, one of the metal molds 51 and 61 is brought closer to another of the metal molds 51 and 61 in the same water vapor atmosphere to sandwich and compress the main part 11. As a result, the main part 11 is deformed into a three-dimensional shape corresponding to a gap formed between the metal molds 51 and 61. In FIG. 4, thickness r of the main part 11 after the compression is substantially uniform.

If the thickness of the main part 11 as cut out from the raw wood 41 is indicated by R, compression rate C of the main part 11 in the compression process can be represented as (R−r)/R. Specifically, the compression rate C is approximately in the range of 0.5 to 07.

After the main part 11 is left in the state as shown in FIG. 4 for a predetermined time period, the metal mold 51 is separated from the metal mold 61 to release the main part 11 from compression and water vapor atmosphere, and then the main part 11 is dried. Depending on the type of wooden material of the main part 11, the main part 11 recovers the original shape when released from the metal molds 51 and 61. When such a wooden material is employed, the main part 11 is left sandwiched between the metal molds 51 and 61 during the compression release and drying. Time for drying the main part 11 is set to a most appropriate value depending on the type and the shape of the main part 11.

The compression process of the main part 11 is described above. The sub-part 12 is similarly processed in the compression process. In particular, the sub-part 12 cut out from the raw wood 41 is left in a water vapor atmosphere of high temperature and high pressure for a predetermined time period. Then, the sub-part 12 is sandwiched between two metal molds (not the metal molds 51 and 61) and subjected to compressing force for a predetermined time period for deformation into a desired shape. After the compression process, the sub-part 12 is released from compression and left to be dried. Thus the sub-part 12 is formed into a finished shape.

Finally, with the joining of the main part 11 and the sub-part 12 after the deformation in the above-described compression process, the compressed wood product 1 is finished. In the joining, portions of the main part 11 and the sub-part 12 that should be joined together are brought into contact after the application of adhesive. Alternatively, a groove may be formed on a surface of the main part 11 which would contact with a surface of the sub-part 12, for example, and a protrusion which would fit the groove may be formed on the surface of the sub-part 12. Then, the joining may be realized by aligning the main part 11 and the sub-part 12 by fitting the protrusion into the groove.

Still alternatively, a plurality of protrusions may be formed on one of the main part 11 and the sub-part 12 so that the protrusions extend towards another of the main part 11 and the sub-part 12 at the joining. Then, a plurality of depressions which would fit the plurality of protrusions may be formed in another of the main part 11 and the sub-part 12. The protrusions may be fit the depressions at the joining. Further, if holes of same diameter are formed in the protrusions and the depressions so that the hole in the protrusion is located at the same position as the hole in the depression when the main part 11 and the sub-part 12 are joined, the main part 11 and the sub-part 12 may be fixed integrally by inserting a bolt into the hole and tightening the bolt with a nut, or by filling in a buffer member such as a rubber bush therein. Then, the application of adhesive to the contact surfaces is not necessary.

Thus, various conventional techniques for securely holding the wooden parts together can be employed at the joining of the main part 11 and the sub-part 12.

Figure 5:
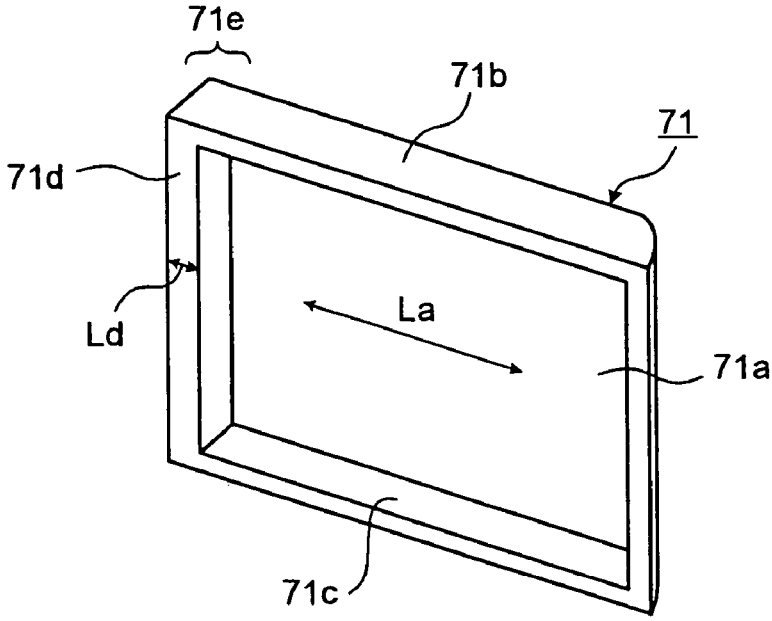
FIG. 5 is a perspective view of a compressed wood product made of a wooden sheet according to a comparative example of the embodiment of the present invention.

To clarify the features of the embodiment of the present invention, a comparative example is described hereinbelow. In the comparative example, a compressed wood product of the same shape as the compressed wood product 1 is manufactured from one wooden sheet. FIG. 5 is a perspective view of the compressed wood product formed from a wooden sheet. A compressed wood product 71 shown in FIG. 5 is of the same shape as the compressed wood product 1 and includes a main plate 71*a* (corresponding to the main plate 11*a* of the compressed wood product 1), side plates 71*b* and 71*c* (corresponding to the side plates 11*b* and 11*c*, respectively), and a side plate 71*d* (corresponding to the sub-part 12).

When the compressed wood product 71 is cut out from the raw wood 41, a direction $L_d$ of wooden fibers of the side plate 71*d* is substantially parallel with a direction $L_a$ of wooden fibers of the main plate 71*a*. As a result, the wooden fibers of the side plate 71*d* is substantially parallel with a thickness direction of the side plate 71*d* and thus short in length, which in turn renders the side plate 71*d* low in strength compared with other portions. In addition, since an angle of a curve formed by an external surface of a curved portion 71*e* which extends between the main plate 71*a* and the side plate 71*d* is approximately 90 degrees, i.e., extremely sharp, the processing is difficult. Still in addition, when such a curved shape is subjected to the compression process with metal molds similarly to the above-described embodiment, damages such as burr or crack tend to be caused on the external surface of the curved portion 71*e*.

Contrarily, in the compressed wood product 1, the direction $L_{12}$ of wooden fibers of the sub-part 12 is substantially parallel with the lengthwise direction of the sub-part 12 and substantially perpendicular to the thickness direction thereof. Hence, the length of the wooden fibers is also longer than that in the side plate 71*d* of the compressed wood product 71. Thus, the strength of the sub-part 12 according to the embodiment can be extremely higher than the strength of the side plate 71*d* of the comparative example. In addition, a portion which needs to be bent at a sharp angle during the processing can be formed from separate wooden parts. Then, damages, such as burr or crack, which are often generated in a formation of the wood product from one wooden sheet as in the comparative example, to the finished product can be prevented.

As is clear from the comparison with the comparative example, the compressed wood product according to the embodiment is formed from plural parts to realize a three-dimensional shape. Different from the processing from one wooden sheet, each of wooden parts constituting the plural parts is not extremely low in strength at a specific position or in a specific direction. Thus, a product formed from such parts also has a high and uniform strength at any position and in any direction. In addition, such processing allows for readily forming and prevents inconveniences such as burr and crack.

Figure 6:
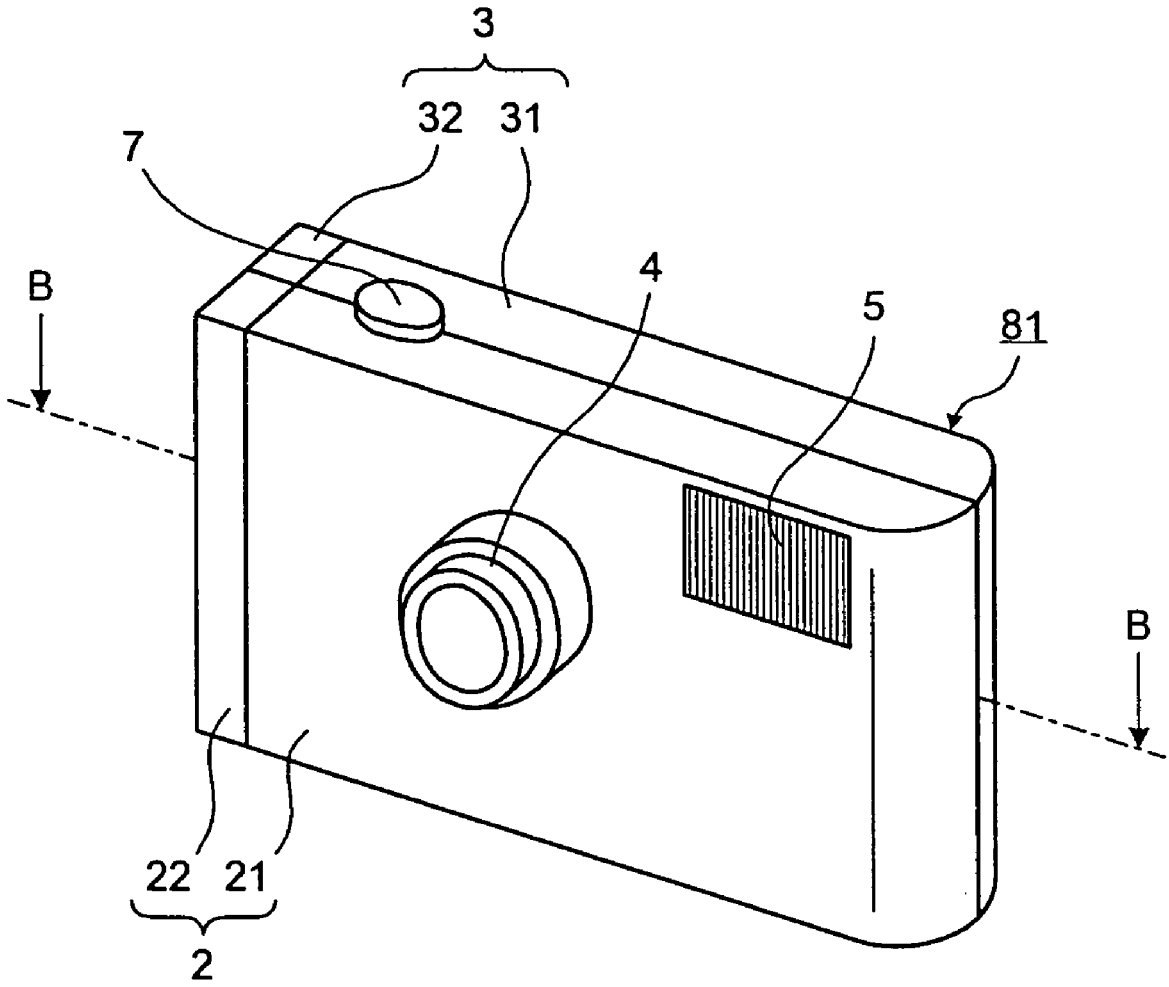
FIG. 6 is a perspective view of an external structure of a digital camera to which the compressed wood product according to the embodiment of the present invention is applied as an exterior material.

FIG. 6 is one example of application of the compressed wood product 1 manufactured as described above. More specifically, FIG. 6 is a perspective view of a digital camera formed with the compressed wood product according to the embodiment as an exterior material. A digital camera 81 shown in FIG. 6 includes two covering materials 2 and 3 joined together to serve as the exterior material. The compressed wood product 1 is processed as to have an opening or the like to serve as the covering material 2 or 3.

Figure 7:
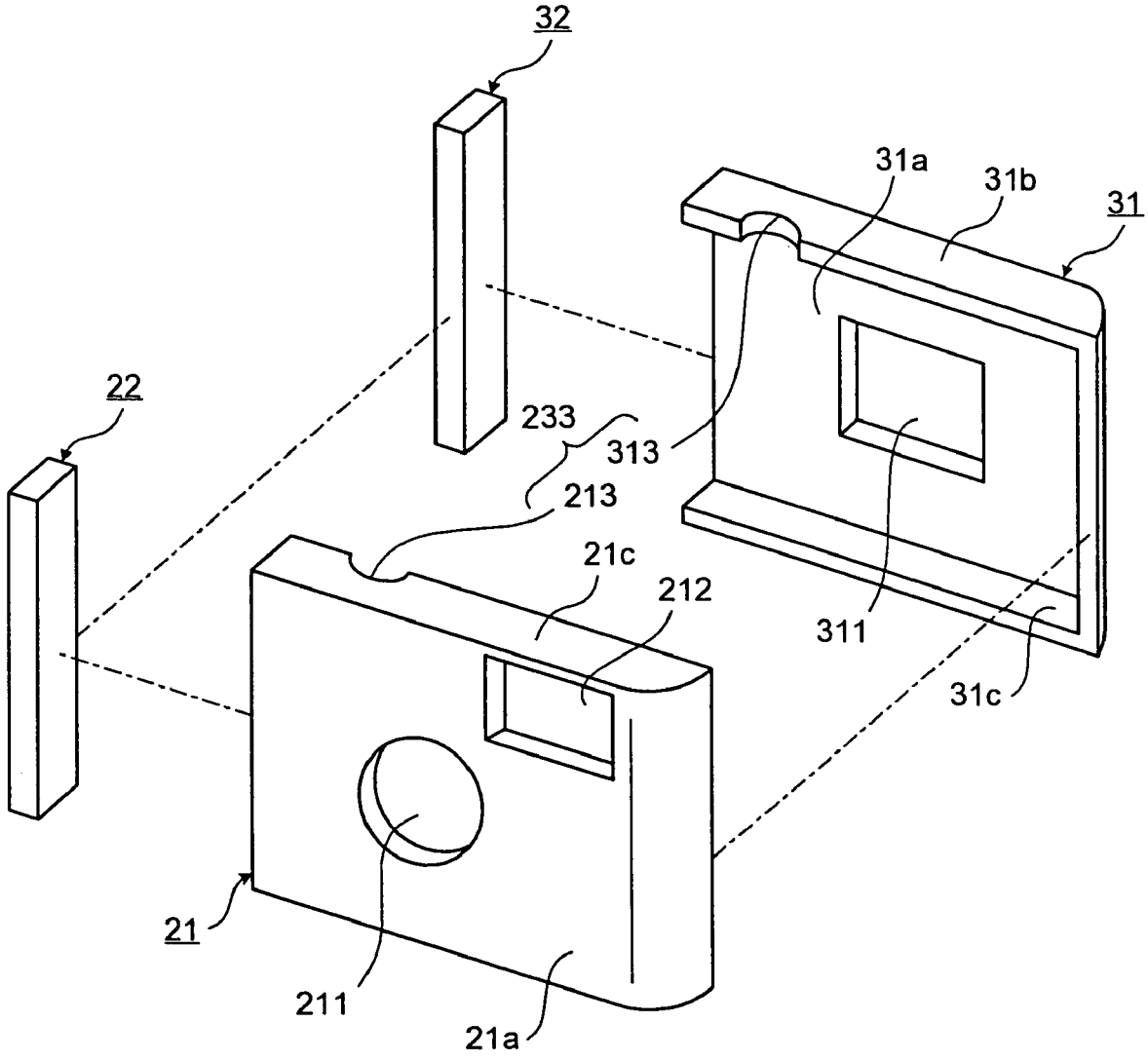
FIG. 7 is a perspective view of the structure of the compressed wood product according to the embodiment of the present invention.

FIG. 7 is a schematic perspective view of a structure of the exterior material of the digital camera 81. As shown in FIG. 7, the exterior material of the digital camera 81 is formed from the covering materials 2 and 3 each including an opening, a cut-out portion, or the like, and facing with each other. Thus, the covering materials 2 and 3 have the same structure as the compressed wood product 1 other than that the covering materials 2 and 3 include the opening, the cut-out portion, or the like.

More specific structure of each of the covering materials will be described. The covering material 2 includes a main part 21 and a sub-part 22. The main part 21, similarly to the main part 11 of the compressed wood product 1, includes a main plate 21*a*, and side plates 21*b* and 21*c*. The main plate 21*a* includes a circular cylindrical opening 211 to expose an imaging unit 4 having an imaging lens, and a rectangular solid opening 212 to expose a photoflash 5. The side plate 21*c* includes a half-circular cylindrical cut-out portion 213.

On the other hand, the covering material 3 includes a main part 31 and a sub-part 32. The main part 31 includes a main plate 31*a*, and side plates 31*b* and 31*c*. The main plate 31*a* has a rectangular solid opening 311 to expose a display 6 which is implemented by a liquid crystal display, a plasma display, or an organic electroluminescence (EL) display, or the like for displaying image information or textual information. The side plate 31*b* includes a half-circular cylindrical cut-out portion 313.

The openings and the cut-out portions in the covering materials 2 and 3 may be all at once formed at the cut-out of the covering materials from the raw wood 41. Alternatively, further opening or cut-out portion may be provided to expose a finder or a manual operation button. Still alternatively, an audio output hole may be provided as a plurality of small holes to externally output sounds generated by a speaker embedded in the digital camera 81. Still alternatively, further opening or the like may be provided to expose a connecting terminal such as a universal serial bus (USB) terminal, an mounting unit for an external storage medium such as an xD picture card or a smart media, and a receptacle for power supply or the like.

When the covering materials 2 and 3 with the above-described structures are joined together in the shape of the digital camera 81, the cut-out portion 213 of the covering material 2 and the cut-out portion 313 of the covering material 3 face with each other and form a circular cylindrical opening 233 to expose a shutter button 7.

The joining of the covering materials 2 and 3 in an assembly of the digital camera 81 is realized similarly to the joining of the main part 21 and the sub-part 22, or the main part 31 and the sub-part 32, i.e., through the application of adhesive to respective contact surfaces. After the joining of two covering materials 2 and 3, an interface of the contact portions of two covering materials 2 and 3 may be covered with sealant, such as an elastic material and sealed. Alternatively, a groove may be formed on an end of one of two covering materials 2 and 3, and a protrusion which would fit the groove may be formed on an end of another of the covering materials 2 and 3, and the protrusion may be made to fit the groove at the joining.

Figure 8:
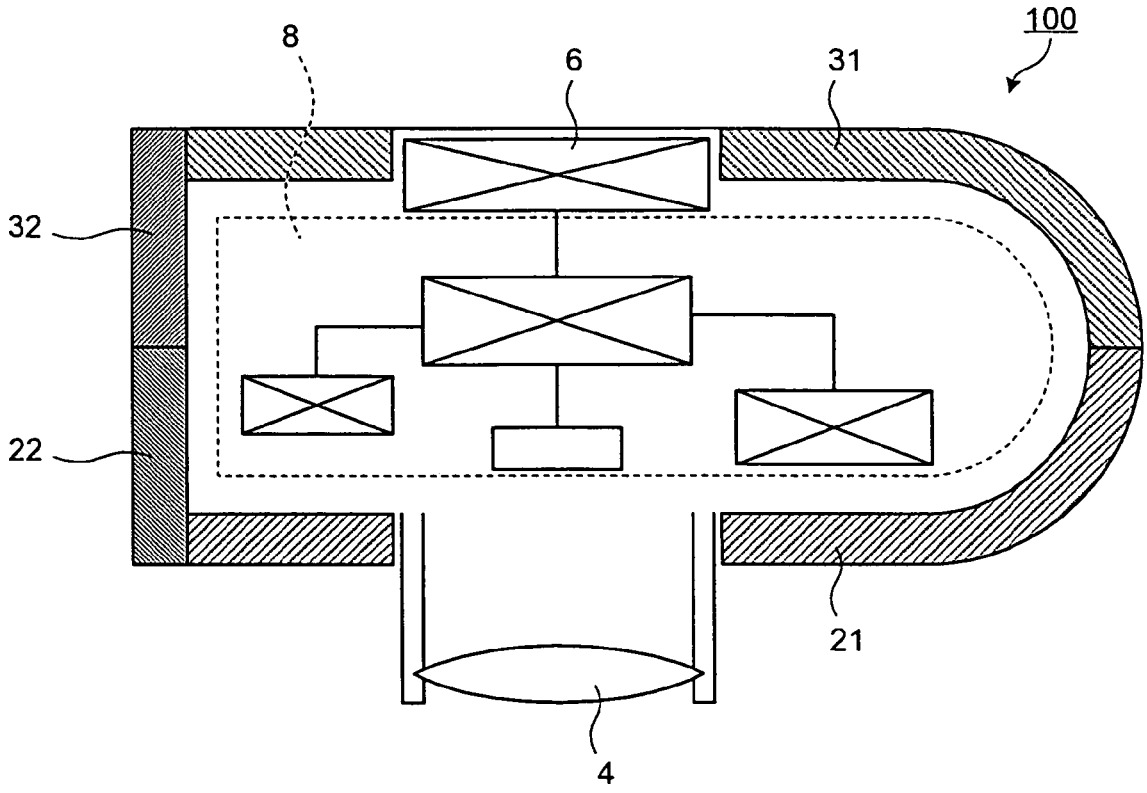
FIG. 8 is a sectional view along a line B-B shown in FIG. 6.

FIG. 8 is a sectional view along a line B-B of FIG. 6, and shows a schematic structure of inside of the digital camera 81. As shown in FIG. 8, the digital camera 81 houses a control unit 8 with a control circuit that performs drive control related to imaging process or the like, an imaging pick-up device such as a charge coupled device (CCD), and electronic units including an audio input-output device such as a microphone, a speaker or the like. The control circuit is realized with a central processing unit (CPU) having functions of operation and control, and a flash memory which stores various information such as a program for launching a predetermined operating system (OS).

As described above, when the compressed wood product according to the embodiment is applied to an electronic device such as a digital camera, a necessary strength for an exterior material can be realized without influence on the appearance of the electronic device. In addition, since wood exposed on a surface of the exterior material has grains and unevenness which serve as antislip, operability of the electronic device in hand can be improved.

Alternatively, two sub-parts 22 and 32 may be formed from one wooden part via compression process. Then, the number of parts of the exterior material can be reduced and the joining process can be eliminated, hence, such alternative is advantageous for mass production of electronic devices such as digital cameras.

The compressed wood product according to the embodiment can be applied as an exterior material to various electronic devices other than a digital camera, for example, a portable communication terminal such as a portable telephone, a personal handyphone system (PHS) or a personal digital assistant (PDA), a portable audio device which mounts audio recording medium such as MD, CD, DVD, or cartridge tape to output sound, an IC recorder, a portable television, a portable radio, remote controls of various home appliances, and a digital video. Further, the compressed wood product according to the embodiment can be employed for purposes other than as an exterior material for electronic devices.

According to the embodiment of the present invention as described above, the compressed wood product includes the first part which is obtained via compression process of the shaped wooden material which contains wooden fibers that run along a direction substantially parallel with the lengthwise direction of the wooden material and intersects with the thickness direction of the wooden material, and the second part which is different from the first part and joined with the first part so that at least one surface thereof is substantially perpendicular to the lengthwise direction of the first part. Thus, regardless of the particular three-dimensional shape of the compressed wood product, each of the plural parts constituting the three-dimensional shape is not extremely low in strength at particular portion or in particular direction. Therefore, the compressed wood product as a whole formed from these plural parts can also possess a high and uniform strength at any portion and in any direction.

The shape of the compressed wood product according to the embodiment is not limited to the shape as described above. Further, the number of the wooden parts constituting the compressed wood product may naturally change according to the three-dimensional shape of the compressed wood product.

Though the embodiment of the present invention is described above in details, the present invention is not limited to the embodiment described above.

For example, one of the main part and the sub-part in the compressed wood product described above may be composed of metal (e.g., aluminum, titanium, iron, stainless steel), or of thermoplastic resin (e.g., polyamide, polyacetal, polyester, polycarbonate, ABS, and reinforced resin thereof reinforced with glass fiber or the like). Further, one of the main part and the sub-part may be composed of a material containing at least one of metal and thermoplastic resin. Then, the strength of the compressed wood product can be enhanced regardless of the direction of wooden fibers in one of main part and the sub-part, which is composed of wood.

More generally, the compressed wood product according to the present invention may be formed as a suitable combination of plural wooden parts and a part composed of a material containing at least one of metal and thermoplastic resin. Then, similarly the strength of the compressed wood product can be enhanced.

Further, the surface of wood after the compression process may be burnt. With the burning process of the wooden surface, a carbonized layer formed on the surface becomes a conductor which acts as an extremely light electromagnetic shield compared with metal. Thus, the compressed wood product subjected to the burning process is appropriate as the exterior material for portable electronic devices.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A compressed wood product comprising:

a first wooden part compressed into a predetermined shape, the first wooden part having a main plate and a side plate, the main plate having a curved surface in a vicinity of one end and a plane surface in a vicinity of another end, the side plate extending along a lengthwise direction of the main plate and in the direction substantially perpendicular to the main plate; and a second part to be joined with the first wooden part, wherein a direction of wooden fibers of the first wooden part is substantially parallel with a lengthwise direction of the first wooden part and intersects with a thickness direction of the first wooden part, and at least one surface of the second part is substantially perpendicular to the lengthwise direction of the first wooden part.

2. The compressed wood product according to claim 1, wherein the second part is made of wood compressed into a predetermined shape, and a direction of wooden fibers of the second part is substantially parallel with a lengthwise direction of the second part and intersects with a thickness direction of the second part.

3. The compressed wood product according to claim 1, wherein the second part includes at least one of metal and thermoplastic resin.

4. The compressed wood product according to claim 1, wherein the compressed wood product is an exterior material for an electronic device.

5. A method of manufacturing a compressed wood product including a first wooden part and a second part joined with the first wooden part, the method comprising:

forming the first wooden part having a main plate and a side plate by cutting out of wood into a first wooden material to be the first wooden part so that a direction of wooden fibers of the first wooden material is substantially parallel with a lengthwise direction of the first wooden material and intersects with a thickness direction of the first wooden material, and further compressing the first wooden material into a predetermined shape having the main plate and the side plate, the main plate having a curved surface in a vicinity of one end and a plane surface in a vicinity of another end, the side plate extending along a lengthwise direction of the main plate and in the direction substantially perpendicular to the main plate; and joining the first wooden part and the second part so that at least one surface of the second part is substantially perpendicular to the lengthwise direction of the first wooden part.

6. The method of manufacturing the compressed wood product according to claim 5, wherein the second part is made of wood, and the second part is formed by cutting out of wood into a second wooden material to be the second part so that a direction of wooden fibers of the second wooden material is substantially parallel with a lengthwise direction of the second wooden material and intersects with a thickness direction of the second wooden material, and further compressing the second wooden material into a predetermined shape.

7. The method of manufacturing the compressed wood product according to claim 5, wherein the second part includes at least one of metal and thermoplastic resin.

* * * * *